US008932001B2

(12) United States Patent
Zheng et al.

(10) Patent No.: US 8,932,001 B2
(45) Date of Patent: Jan. 13, 2015

(54) SYSTEMS, METHODS, AND APPARATUS FOR A LABYRINTH SEAL

(75) Inventors: Xiaoqing Zheng, Schenectady, NY (US); Hrishikesh Deo, Niskayuna, NY (US); Binayak Roy, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 612 days.

(21) Appl. No.: 13/226,122

(22) Filed: Sep. 6, 2011

(65) Prior Publication Data

US 2013/0058766 A1 Mar. 7, 2013

(51) Int. Cl.

| | |
|---|---|
| ***F04D 29/16*** | (2006.01) |
| ***F01D 11/02*** | (2006.01) |
| ***F01D 11/00*** | (2006.01) |

(52) U.S. Cl.

CPC ..... *F04D 29/161* (2013.01); *F01D 11/025* (2013.01); *F01D 11/003* (2013.01); *F01D 11/02* (2013.01)

USPC ..... 415/1; 415/113; 415/173.3; 415/173.5; 415/174.2; 415/174.5; 415/231

(58) Field of Classification Search

USPC ..... 415/1, 113, 173.3, 173.4, 173.5, 174.2, 415/174.4, 174.5, 230, 231; 416/1, 174; 277/411, 412, 413, 416, 417, 418, 419, 277/420, 421; 29/889.21

See application file for complete search history.

(56) References Cited

U.S. PATENT DOCUMENTS

| | | | | |
|---|---|---|---|---|
| 1,392,035 | A * | 9/1921 | Williams | 277/453 |
| 1,831,224 | A * | 11/1931 | Baumann | 277/418 |
| 3,678,809 | A * | 7/1972 | Doutt | 92/86 |
| 3,971,563 | A * | 7/1976 | Sugimura | 277/413 |
| 4,290,610 | A * | 9/1981 | Lizogub et al. | 277/417 |
| 4,337,956 | A * | 7/1982 | Hopper | 277/552 |
| 5,029,876 | A * | 7/1991 | Orlando et al. | 277/419 |
| 5,224,713 | A * | 7/1993 | Pope | 277/415 |
| 5,244,216 | A * | 9/1993 | Rhode | 277/303 |
| 5,314,304 | A * | 5/1994 | Wiebe | 415/173.4 |
| 5,547,340 | A * | 8/1996 | Dalton et al. | 415/121.2 |
| 5,599,026 | A * | 2/1997 | Sanders et al. | 277/415 |
| 5,799,952 | A * | 9/1998 | Morrison et al. | 277/355 |
| 5,890,873 | A * | 4/1999 | Willey | 415/173.5 |
| 6,250,879 | B1 * | 6/2001 | Lampes | 415/174.2 |
| 6,572,115 | B1 * | 6/2003 | Sarshar et al. | 277/412 |

(Continued)

FOREIGN PATENT DOCUMENTS

| | | | | |
|---|---|---|---|---|
| JP | 58162704 | A * | 9/1983 | F01D 11/02 |

*Primary Examiner* — Edward Look

*Assistant Examiner* — Wayne A Lambert

(74) *Attorney, Agent, or Firm* — Sutherland Asbill & Brennan LLP

(57) ABSTRACT

Certain embodiments of the invention may include systems, methods and apparatus for providing a labyrinth seal. In an example embodiment, a method is provided for sealing a flow path between a stationary element and a rotating element of a turbomachine. The method can include disposing at least one fixture on an inner surface of a stationary element associated with the turbomachine; disposing a packing ring linked via a spring element to the fixture wherein the packing ring comprises at least one bore; and disposing, according to a predetermined profile, a plurality of interdigitated packing ring teeth and rotor teeth intermediate to the packing ring and the rotating element; wherein the bore, packing ring teeth, and rotor teeth, cooperate to counter a moment associated with one or more axial forces.

17 Claims, 5 Drawing Sheets

(56) References Cited

U.S. PATENT DOCUMENTS

| | | | | |
|---|---|---|---|---|
| 6,840,519 | B2 * | 1/2005 | Dinc et al. | 277/413 |
| 6,854,735 | B2 * | 2/2005 | Sarshar et al. | 277/355 |
| 7,396,017 | B2 * | 7/2008 | Orlowski et al. | 277/412 |
| 7,458,584 | B2 * | 12/2008 | Addis | 277/355 |
| 7,578,509 | B2 | 8/2009 | Grondahl | |
| 7,704,041 | B2 * | 4/2010 | Adis | 415/174.5 |
| 8,181,965 | B2 * | 5/2012 | Addis | 277/355 |
| 2002/0192074 | A1 * | 12/2002 | Turnquist et al. | 415/173.3 |
| 2003/0062686 | A1 * | 4/2003 | Uehara et al. | 277/411 |
| 2004/0000761 | A1 * | 1/2004 | Addis | 277/355 |
| 2006/0208427 | A1 * | 9/2006 | Wright et al. | 277/413 |
| 2008/0008574 | A1 * | 1/2008 | Brillert | 415/1 |
| 2008/0042366 | A1 * | 2/2008 | Awtar et al. | 277/411 |
| 2008/0048399 | A1 * | 2/2008 | Nicholson et al. | 277/355 |
| 2008/0131269 | A1 * | 6/2008 | Deo et al. | 415/170.1 |
| 2008/0265513 | A1 * | 10/2008 | Justak | 277/301 |
| 2008/0272553 | A1 * | 11/2008 | Awtar et al. | 277/411 |
| 2008/0309018 | A1 * | 12/2008 | Williams | 277/411 |
| 2009/0196742 | A1 * | 8/2009 | Turnquist et al. | 415/174.2 |
| 2009/0274548 | A1 * | 11/2009 | Joco et al. | 415/112 |
| 2009/0297341 | A1 * | 12/2009 | Turnquist et al. | 415/173.3 |
| 2009/0309311 | A1 * | 12/2009 | Verma et al. | 277/411 |
| 2010/0007093 | A1 | 1/2010 | Grondahl | |
| 2011/0182719 | A1 * | 7/2011 | Deo et al. | 415/173.1 |
| 2012/0003080 | A1 * | 1/2012 | Deo et al. | 415/174.5 |
| 2012/0091662 | A1 * | 4/2012 | Neeli et al. | 277/420 |
| 2012/0193875 | A1 * | 8/2012 | Deo et al. | 277/412 |

* cited by examiner

SYSTEMS, METHODS, AND APPARATUS FOR A LABYRINTH SEAL

FIELD OF THE INVENTION

This invention generally relates to sealing an interface between a rotating component, such as a rotor in a turbine or compressor, and a stationary component, such as a casing or stator, and, in particular, relates to a labyrinth seal.

BACKGROUND OF THE INVENTION

Gas turbines, steam turbines, compressors, and other turbomachine systems utilize labyrinth seals to reduce or impede flow leakage between certain areas of rotating and stationary parts associated with the turbomachine. Clearance is typically needed between the seal and rotor to avoid rubbing and/or premature wear, but the clearance needs to be as small as possible to reduce leakage and increase efficiency.

BRIEF SUMMARY OF THE INVENTION

Some or all of the above needs may be addressed by certain embodiments of the invention. Certain embodiments of the invention may include systems, methods, and apparatus for providing a labyrinth seal.

Certain embodiments of the invention may include systems, methods and apparatus for providing a labyrinth seal. In an example embodiment, a method is provided for sealing a flow path between a stationary element and a rotating element of a turbomachine. The method can include disposing at least one fixture on an inner surface of a stationary element associated with the turbomachine; disposing a packing ring linked via a spring element to the fixture wherein the packing ring comprises at least one bore; and disposing, according to a predetermined profile, a plurality of interdigitated packing ring teeth and rotor teeth intermediate to the packing ring and the rotating element; wherein the bore, packing ring teeth, and rotor teeth, cooperate to counter a moment associated with one or more axial forces.

According to another example embodiment, a system is provided for sealing a flow path. The system may include a turbomachine. In an example embodiment, the turbomachine may include a stationary element; a rotating element turning about an axis; at least one fixture disposed on an inner surface of the stationary element; a packing ring linked via a spring element to the fixture, wherein the packing ring comprises at least one bore; and a plurality of interdigitated packing ring teeth and rotor teeth disposed according to a predetermined profile and intermediate to the packing ring and the rotating element; wherein the bore, packing ring teeth, and rotor teeth, cooperate to counter a moment associated with one or more axial forces.

According to another example embodiment, an apparatus is provide for sealing a flow path associated with a turbine. The apparatus includes a stationary element; a rotating element turning about an axis; at least one fixture disposed on an inner surface of the stationary element; a packing ring linked via a spring element to the fixture, wherein the packing ring comprises at least one bore; and a plurality of interdigitated packing ring teeth and rotor teeth disposed according to a predetermined profile and intermediate to the packing ring and the rotating element; wherein the bore, packing ring teeth, and rotor teeth, cooperate to counter a moment associated with one or more axial forces.

Other embodiments, features, and aspects of the invention are described in detail herein and are considered a part of the claimed inventions. Other embodiments and aspects can be understood with reference to the following detailed description, accompanying drawings, and claims.

BRIEF DESCRIPTION OF THE FIGURES

Reference will now be made to the accompanying tables and drawings, which are not necessarily drawn to scale, and wherein.

DETAILED DESCRIPTION OF THE INVENTION

Embodiments of the invention will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Certain embodiments of the invention may provide interdigitated packing ring teeth and rotor teeth along with a bore to counter a moment associated with one or more axial forces that may act upon a labyrinth seal. According to certain example embodiments, the placement and dimension of the interdigitated sealing teeth may be utilized to distribute pressure from an upstream side to a downstream side of a labyrinth seal. In an example embodiment, a bore may be utilized to adjust, modify, or otherwise control a pressure gradient associated with the labyrinth seal.

Various seal parts, teeth, plates, fixtures, etc., may be utilized for providing a seal, according to example embodiments of the invention, and will now be described with reference to the accompanying figures.

Figure 1:
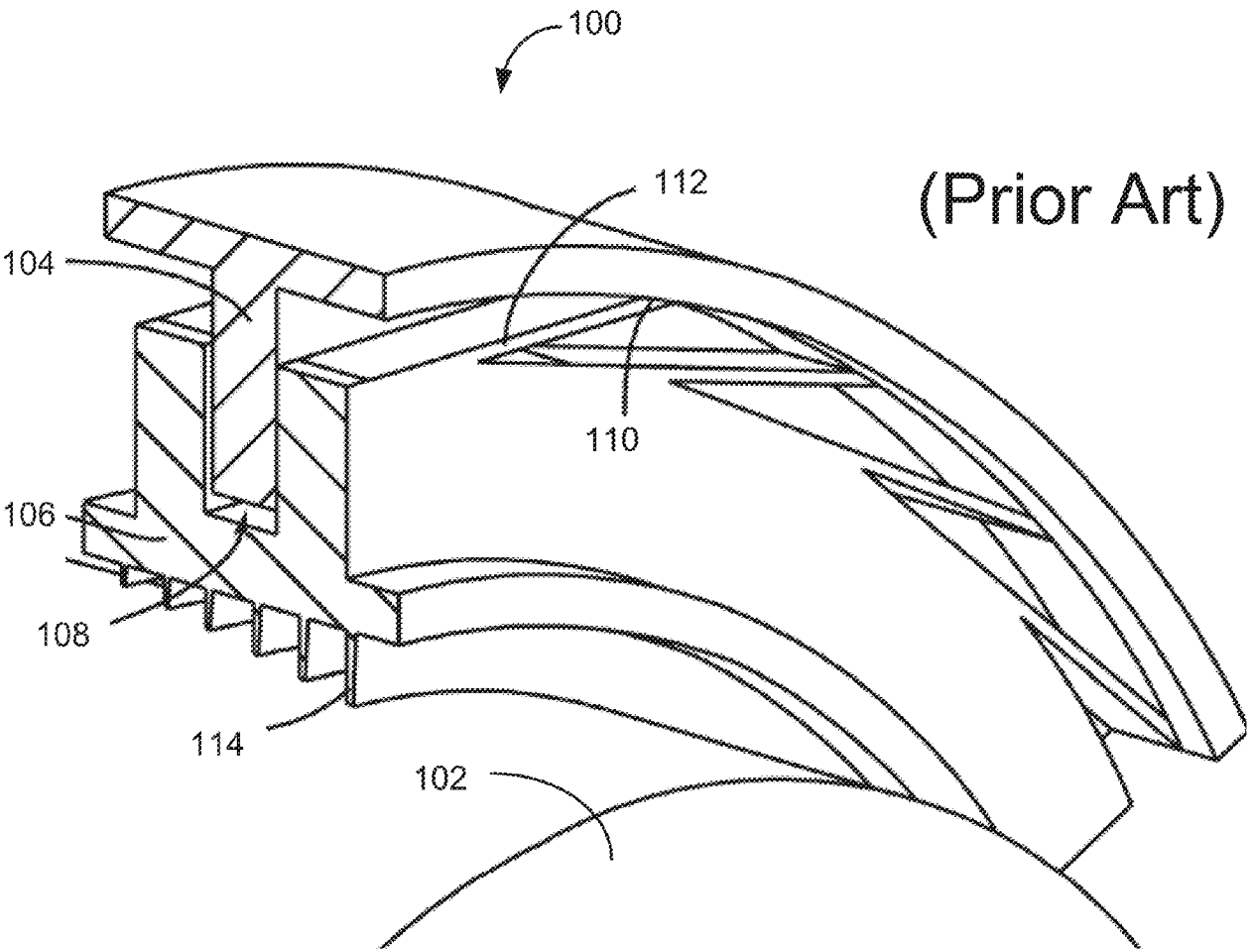
(Prior Art) FIG. 1
FIG. 1 is a depiction of a prior art seal assembly.

FIG. 1 illustrates an example prior art seal assembly 100, which includes a rotating element 102, such as a rotor. An arcuate plate 104 provides a housing for an arcuate packing ring 106. A gap 108 between the arcuate plate 104 and the packing ring 106 may be adjustable via flextures 112 that may be held in alignment by biasing members 110. Teeth 114 attached to the packing ring provide a partial seal at the interface between the packing ring and the rotating element 102.

Figure 2:
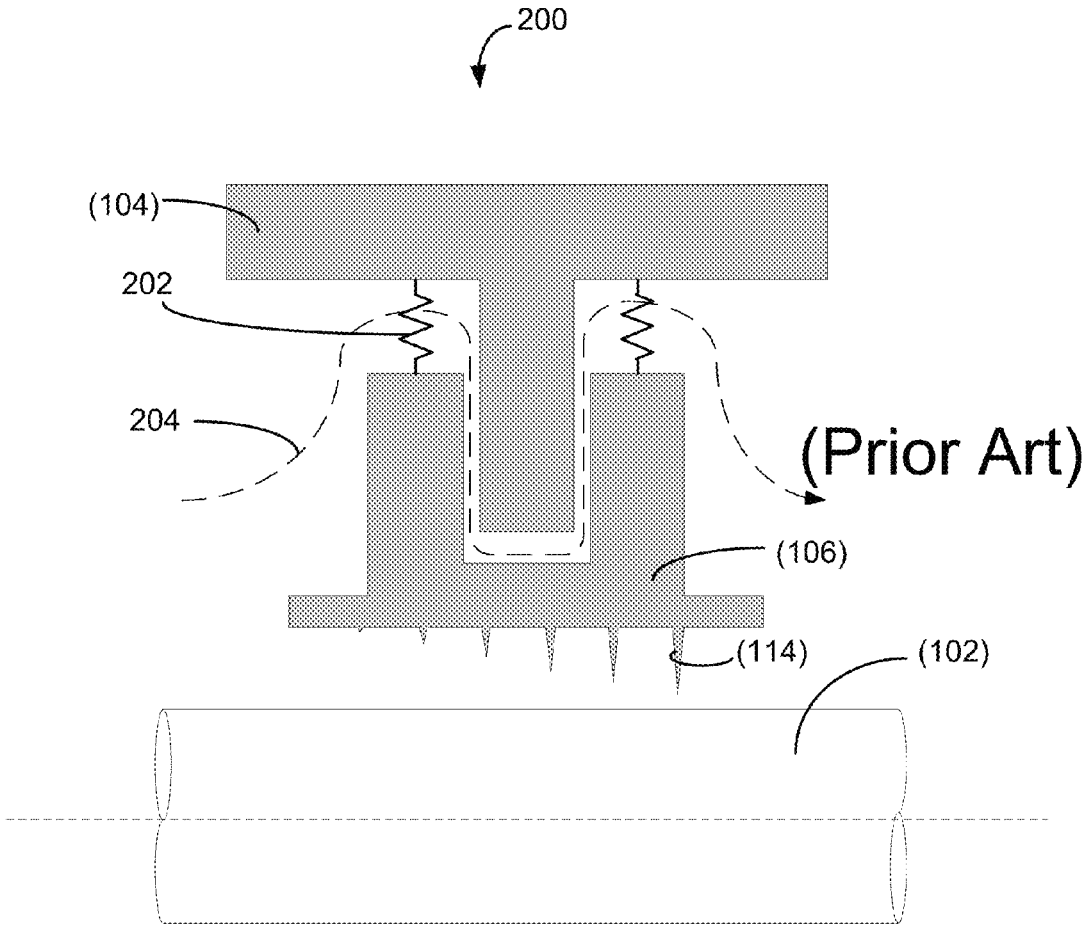
FIG. 2 is diagram of a prior art labyrinth seal assembly.

FIG. 2 illustrates a side view of a prior art seal assembly 200, similar to the seal assembly 100 of FIG. 1. In this prior art seal, flextures 202 are used for holding the packing ring to the arcuate plate. A flow path 204 is established through the flextures and around the interface between the packing ring and plate.

Figure 3:
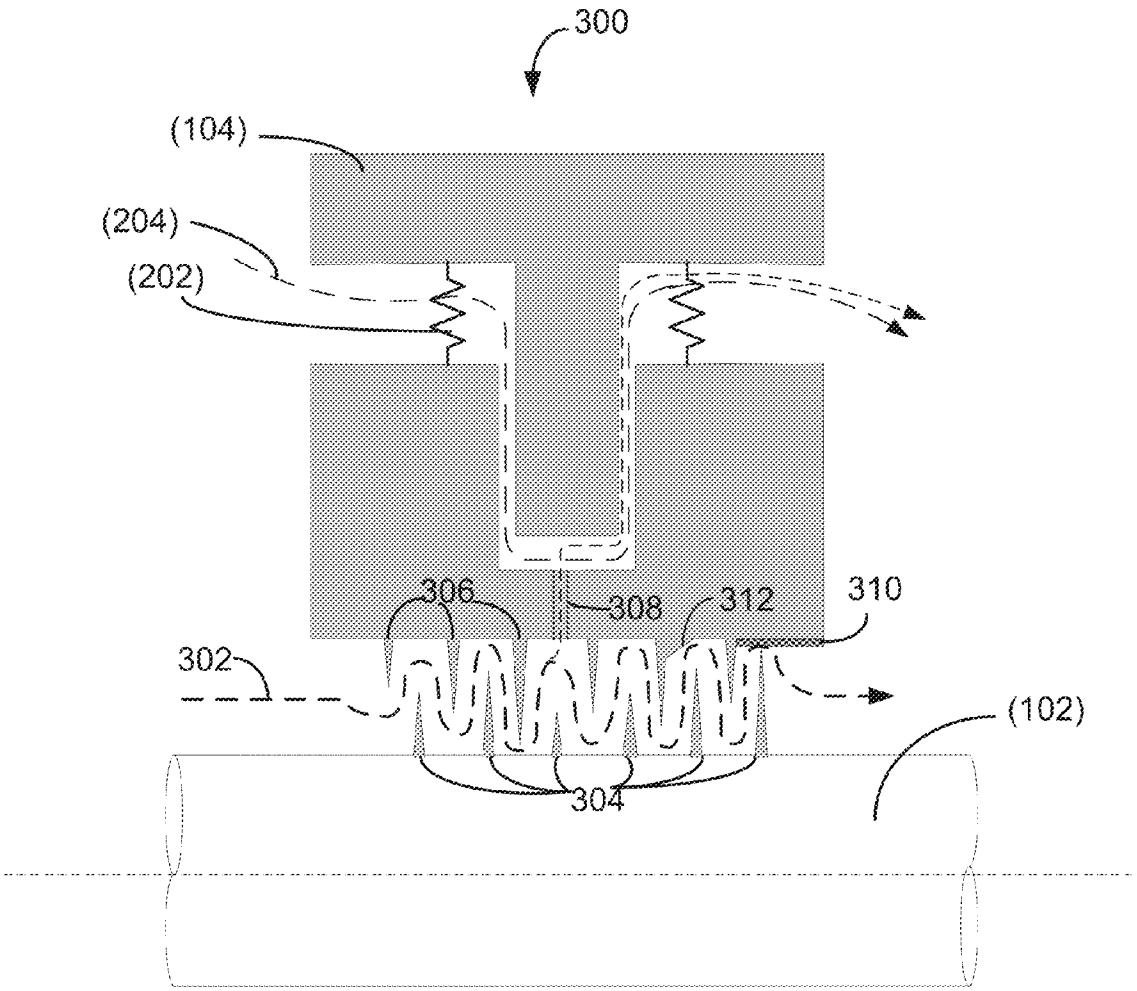
FIG. 3 is a diagram of an example labyrinth seal assembly, according to an embodiment of the invention.

FIG. 3 depicts a seal assembly 300, according to an example embodiment of the invention. In this example embodiment, a leakage path 302 may be defined between rotor teeth 304 and packing ring teeth 306. In an example embodiment, a pressure equalization path 308 may be defined in the packing ring to provide a path for leakage to escape from the leakage path 302 to the secondary leakage path (as in 204 of FIG. 2). In an example embodiment, an abradable coating 310 may be utilized to allow one or more rotor teeth 304 to contact the plate region, and sacrificially abrade the coating 310 without necessarily damaging the teeth or the plate. In another embodiment, at least one sealing surface 312 is partially tapered to change teeth progression if the rotor teeth move away from its design point into the tapered location. The purpose is to increase the seal ring open force if the relative position is shifted axially one way or another during transient to avoid seal rub. As shown in FIG. 3, if the rotor moves axially to the right relative to the packing ring, in each of the grooves between the packing ring teeth, more area is exposed to the higher pressure side. Therefore, in an example embodiment, this may provide an opening force to push the packing ring away to open up clearance and have less risk of rubbing. However, if the rotor moves relatively to the left, the opening force may normally decrease. To compensate for the decrease of opening force, and according to an example embodiment, the sealing surface on the left side is tapered to increase clearance progression and increase pressure in the upstream side. Therefore the opening force can be increased to open up seal overall clearance. The taper can be configured to either reduce clearance at a downstream location, or increase clearance at the upstream location.

Figure 4:
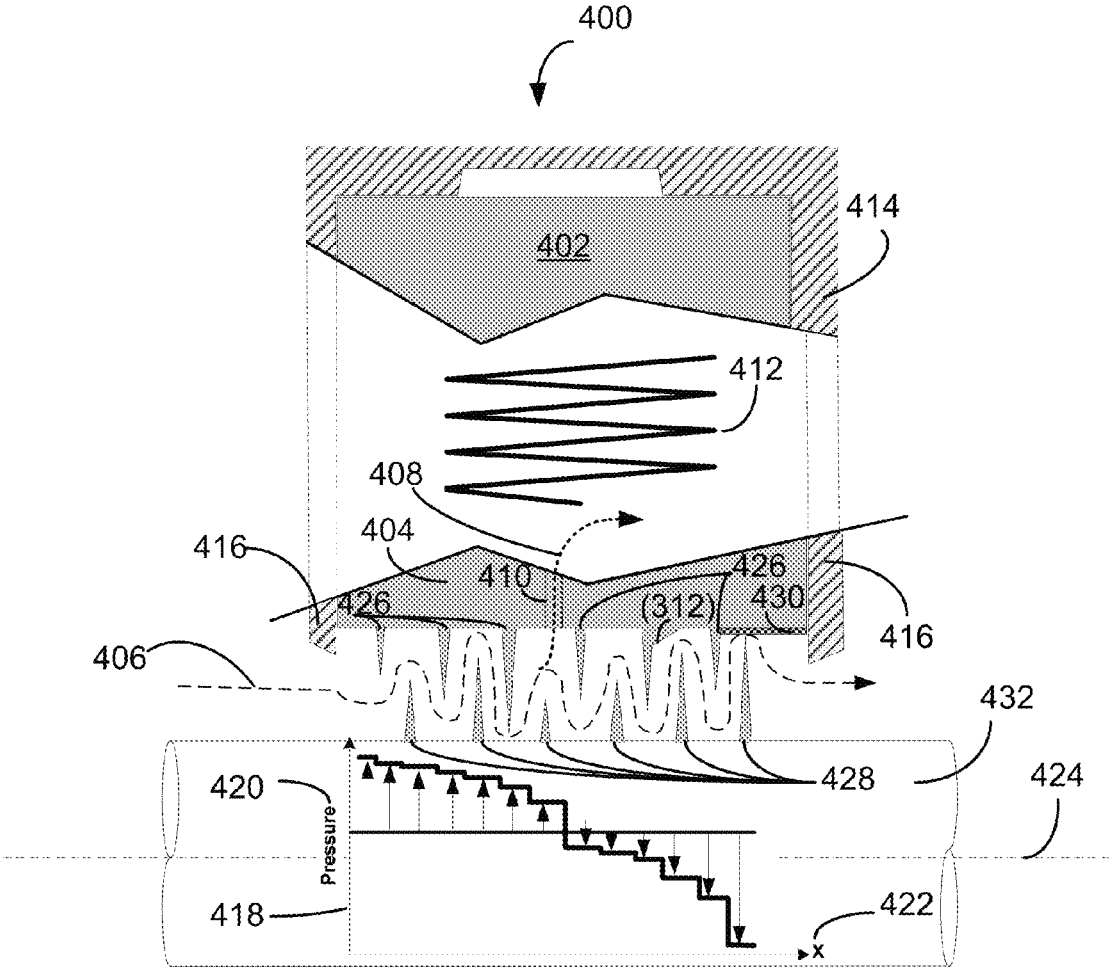
FIG. 4 is another diagram of an example labyrinth seal assembly, according to an embodiment of the invention.

FIG. 4 depicts a seal assembly 400, according to an example embodiment of the invention. In an example embodiment, the seal assembly 400 includes a fixture 402, which may be associated with a stationary element 414 (non-rotating) part of a turbomachine. In an example embodiment, the seal assembly 400 may include an arcuate packing ring 404, which may be in communication with the fixture 402 via a spring element 412.

According to an example embodiment of the invention, a pressure equalization bore 410 may be present in the packing ring 404 to intentionally allow gasses in the flow path 406 to travel along the equalization path 408 and to leak into the flow path between the packing ring 404 and the fixture 402. According to an example embodiment, the pressure equalization bore 410 may provide a reference position for pressure equalization, and may aid in counteracting axial forces and associated rotation of the seal. For example, and in reference to FIG. 4, in an example embodiment, the upstream flow may apply pressure to the left side of the packing ring 404, and the result may be a counterclockwise twisting moment. In an example embodiment, the counterclockwise twisting moment may be at least partially compensated or opposed by the application of the teeth 426, 428 and the pressure equalization bore 410.

According to an example embodiment, one or more axial side plates 416 may be disposed adjacent to the packing ring 404. According to an example embodiment, the axial side plates 416 may be utilized to minimize leakage over the packing ring and to reduce axial loading on the packing rings. In an example embodiment, a reduction in axial loading on the packing rings may reduce the twist moment on the packing ring.

FIG. 4 also depicts an example pressure versus position graph 418 (see inset) corresponding to the pressure 420 along the flow path 406 as a function of position 422. According to an example embodiment, a rotating element 432, rotating about an axis of rotation 424 may include arcuate rotor teeth 428, which may be attached to the rotating element 432 and interdigitated with arcuate packing ring teeth 426. In an example embodiment, the rotor teeth 428 and the packing ring teeth 426 may impede the flow of air or gasses along the flow path 406. According to an example embodiment, the height and position of the rotor teeth 428 and the packing ring teeth 426 may be designed to control the pressure drop along the position 422 of the seal assembly 400. According to an example embodiment, the height and position of the individual rotor teeth 428 and the individual packing ring teeth 426 may be further designed to control, reduce, or minimize teeth rubbing on opposing surfaces.

According to an example embodiment, and depicted by the representative pressure versus position graph 418, the pressure equalization bore 410 may provide or set the pressure differential between the flow path 406 and the secondary leakage path between the packing ring 404 and the fixture 402 to be approximately zero. In an example embodiment, the combination of the controlled pressure drop across the position 422 of the seal assembly 400, and the equalized pressure via the pressure equalization bore 410 may provide a counteracting moment to at least partially balance the twisting moment applied to the packing ring 404 due to incident gas path pressure, as described above.

Figure 5:
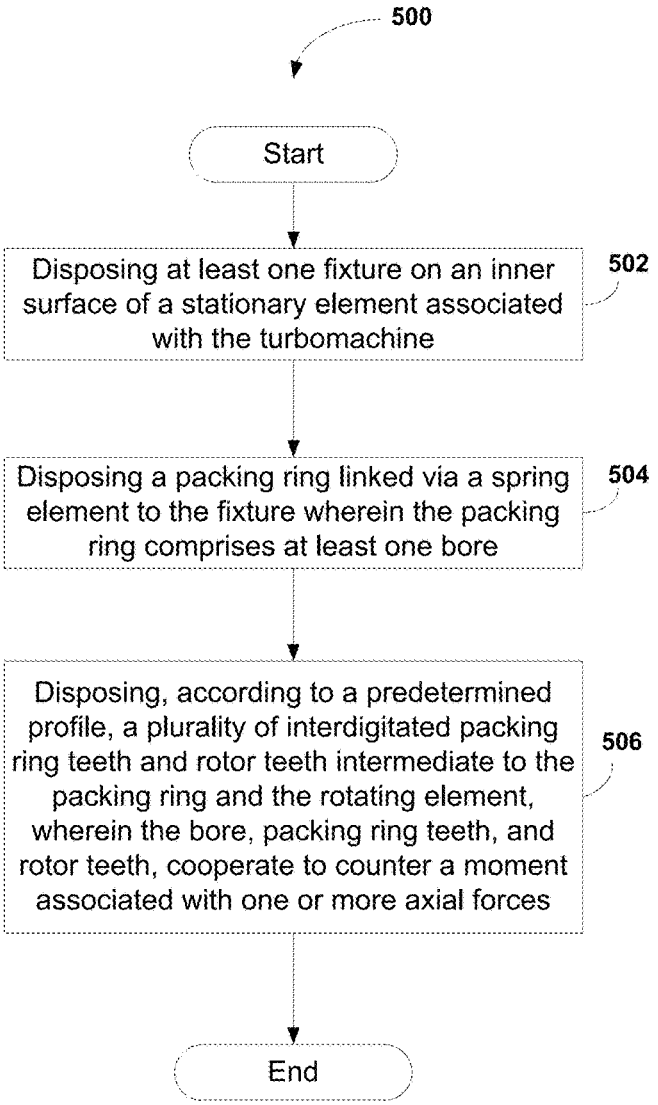
FIG. 5 is a flow diagram of an example method, according to an embodiment of the invention.

An example method 500 for sealing a flow path between a stationary element and a rotating element of a turbomachine will now be described with reference to the flowchart of FIG. 5. The method 500 starts in block 502, and according to an example embodiment of the invention, includes disposing at least one fixture on an inner surface of a stationary element associated with the turbomachine. In block 504, the method 500 includes disposing a packing ring linked via a spring element to the fixture wherein the packing ring comprises at least one bore. In block 506, and according to an example embodiment, the method 500 includes disposing, according to a predetermined profile, a plurality of interdigitated packing ring teeth and rotor teeth intermediate to the packing ring and the rotating element, wherein the bore, packing ring teeth, and rotor teeth, cooperate to counter a moment associated with one or more axial forces. The method 500 ends after block 506

According to example embodiments, the invention may further include at least one axial side plate (416) secured adjacent to the packing ring (404), wherein the side plate (416) is configured to form a secondary seal with the packing ring (404), and/or wherein one or more axial side plates (416) are integral part of the stationary element (414). According to an example embodiment, disposing, according to a predetermined profile, a plurality of interdigitated packing ring teeth and rotor teeth intermediate to the packing ring and the rotating element may include disposing an inner tooth (426, 428) having a first progressive minimum clearance and an outer tooth (426, 428) having a second progressive minimum clearance. In an example embodiment, disposing according to the predetermined profile comprises disposing an outer tooth (426, 428) having a first progressive minimum clearance and an inner tooth (426, 428) having a second progressive minimum clearance. In an example embodiment, disposing the packing ring (404) may include at least one bore (410) in communication with at least a portion of the flow path (406) and at least a portion of a cavity between fixture (402), packing ring (404) and side plates (416) for pressure equalization. An example embodiment may further include disposing an abradable coating (430) on the surface of the packing ring (404) facing the rotating element (432).

According to another example embodiment, a system and/or apparatus is provided for sealing a flow path (406). The system may include a turbomachine. In an example embodiment, the system and/or the apparatus may include a stationary element (414); a rotating element (432) turning about an axis (424); at least one fixture (402) disposed on an inner surface of the stationary element (414); a packing ring (404) linked via a spring element (412) to the fixture (402), wherein the packing ring (404) comprises at least one bore (410); and a plurality of interdigitated packing ring teeth (426) and rotor teeth (428) disposed according to a predetermined profile and intermediate to the packing ring (404) and the rotating element (432); wherein the bore, packing ring teeth (426), and rotor teeth (428), cooperate to counter a moment associated with one or more axial forces.

In an example embodiment, the system or apparatus may further include one or more axial side plates (416) secured to stationary element (414), wherein the one or more axial side plates (416) are configured to seal a cavity between fixture (402) and the packing ring (404), wherein a downstream side of the side plate (416) is flexible and compliant to pressure loading. In an example embodiment, the plurality of interdigitated packing ring teeth (426) and rotor teeth (428) are disposed according to the predetermined profile comprising an inner tooth (426, 428) having a first progressive minimum clearance and an outer tooth (426, 428) having a second progressive minimum clearance. In an example embodiment, the plurality of interdigitated packing ring teeth (426) and rotor teeth (428) are disposed according to the predetermined profile comprising an outer tooth (426, 428) having a first progressive minimum clearance and an inner tooth (426, 428) having a second progressive minimum clearance. In an example embodiment of the system and/or the apparatus, the at least one bore (410) is in communication with at least a portion of the flow path (406) and at least a portion of a cavity between fixture (402), packing ring (404) and side plates (416). In an example embodiment of the system and/or the apparatus, the system and/or apparatus may include an abradable coating (430) disposed on the surface of the packing ring (404) facing the rotating element (432).

According to example embodiments, certain technical effects can be provided, such as creating certain systems, methods, and apparatus that counter a moment associated with one or more axial forces. Example embodiments of the invention can provide the further technical effects of providing systems, methods, and apparatus for equalizing pressure associated with a labyrinth seal. As desired, embodiments of the invention may include the seal assembly 300 and the seal assembly 400 with more or less of the components illustrated in FIGS. 3 and 4.

While certain embodiments of the invention have been described in connection with what is presently considered to be the most practical and various embodiments, it is to be understood that the invention is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain embodiments of the invention, including the best mode, and also to enable any person skilled in the art to practice certain embodiments of the invention, including making and using any devices or systems and performing any incorporated methods. The patentable scope of certain embodiments of the invention is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The claimed invention is:

1. A method for sealing a flow path between a stationary element and a rotating element of a turbomachine, the method comprising:

disposing at least one fixture on an inner surface of a stationary element associated with the turbomachine;

disposing a packing ring linked via a spring element to the fixture wherein the packing ring comprises at least one bore;

disposing, according to a predetermined profile, a plurality of interdigitated packing ring teeth and rotor teeth intermediate to the packing ring and the rotating element;

wherein the bore, the packing ring teeth, and the rotor teeth cooperate to counter a moment associated with one or more axial forces; and wherein the bore provides a pressure equalization path from a flow path between the rotor teeth and the packing ring teeth into a secondary leakage path between the packing ring and the fixture, wherein a pressure differential between the flow path and the secondary leakage path is approximately zero.

2. The method of claim 1, further comprising at least one axial side plate secured adjacent to the packing ring, wherein the side plate is configured to form a secondary seal with the packing.

3. The method of claim 2, wherein one or more axial side plates are integral part of the stationary element.

4. The method of claim 1, wherein disposing according to the predetermined profile comprises disposing an inner tooth having a first progressive minimum clearance and an outer tooth having a second progressive minimum clearance.

5. The method of claim 1, further comprising tapering at least a portion of one sealing surface for progressive clearance.

6. The method of claim 1, further comprising disposing an abradable coating on the surface of the packing ring facing the rotating element.

7. A system for sealing a flow path, the system comprising:

a turbomachine comprising:

a stationary element;

a rotating element turning about an axis;

at least one fixture disposed on an inner surface of the stationary element;

a packing ring linked via a spring element to the fixture, wherein the packing ring comprises at least one bore; and a plurality of interdigitated packing ring teeth and rotor teeth disposed according to a predetermined profile and intermediate to the packing ring and the rotating element;

wherein the bore, the packing ring teeth, and the rotor teeth cooperate to counter a moment associated with one or more axial forces; and wherein the bore provides a pressure equalization path from a flow path between the rotor teeth and the packing ring teeth into a secondary leakage path between the packing ring and the fixture, wherein a pressure differential between the flow path and the secondary leakage path is approximately zero.

8. The system of claim 7, further comprising one or more axial side plates secured to the stationary element, wherein the one or more axial side plates are configured to seal a cavity between the fixture and the packing ring.

9. The system of claim 8, wherein a downstream side of the side plate is flexible and compliant to pressure loading.

10. The system of claim 7, wherein the plurality of interdigitated packing ring teeth and rotor teeth are disposed according to the predetermined profile comprising an inner tooth having a first progressive minimum clearance and an outer tooth having a second progressive minimum clearance.

11. The system of claim 7, wherein the plurality of interdigitated packing ring teeth and rotor teeth are disposed according to the predetermined profile comprising at least one sealing surface having a tapered portion that changes clearance progression.

12. The system of claim 7, further comprising an abradable coating disposed on the surface of the packing ring facing the rotating element.

13. An apparatus for sealing a flow path associated with a turbine, the apparatus comprising:

a stationary element;

a rotating element turning about an axis;

at least one fixture disposed on an inner surface of the stationary element;

a packing ring linked via a spring element to the fixture, wherein the packing ring comprises at least one bore; and a plurality of interdigitated packing ring teeth and rotor teeth disposed according to a predetermined profile and intermediate to the packing ring and the rotating element;

wherein the bore, the packing ring teeth, and the rotor teeth cooperate to counter a moment associated with one or more axial forces; and wherein the bore provides a pressure equalization path from a flow path between the rotor teeth and the packing ring teeth into a secondary leakage path between the packing ring and the fixture, wherein a pressure differential between the flow path and the secondary leakage path is approximately zero.

14. The apparatus of claim 13, further comprising one or more axial side plates secured to the stationary element, wherein the one or more axial side plates are configured to seal a cavity between the fixture and the packing ring.

15. The apparatus of claim 14, wherein a downstream side of the side plate is flexible and compliant to pressure loading.

16. The apparatus of claim 13, wherein the plurality of interdigitated packing ring teeth and rotor teeth are disposed according to the predetermined profile comprising an inner tooth having a first progressive minimum clearance and an outer tooth having a second progressive minimum clearance, or an outer tooth having a first progressive minimum clearance and an inner tooth having a second progressive minimum clearance.

17. The apparatus of claim 13, further comprising an abradable coating disposed on the surface of the packing ring facing the rotating element.

* * * * *